US005580283A

United States Patent [19]

O'Sullivan et al.

[11] Patent Number: 5,580,283

[45] Date of Patent: Dec. 3, 1996

[54] ELECTRICAL CONNECTOR HAVING TERMINAL MODULES

[75] Inventors: Michael O'Sullivan, Willowbrook; James A. Wetter, Hoffman Estates, both of Ill.

[73] Assignee: Molex Incorporated, Lisle, Ill.

[21] Appl. No.: 525,806

[22] Filed: Sep. 8, 1995

[51] Int. Cl.[6] ..... H01R 13/502

[52] U.S. Cl. ..... 439/686; 439/607

[58] Field of Search ..... 439/686, 701, 439/345, 350–357, 607–610

[56] References Cited

U.S. PATENT DOCUMENTS

| | | | |
|---|---|---|---|
| 4,797,123 | 1/1989 | Weber | 439/717 |
| 4,820,169 | 4/1989 | Weber et al. | 439/65 |
| 5,090,920 | 2/1992 | Casey | 439/540 |
| 5,295,870 | 3/1994 | Rei et al. | 439/717 |
| 5,304,069 | 4/1994 | Brunker et al. | 439/108 |
| 5,385,490 | 1/1995 | Demeter et al. | 439/579 |

OTHER PUBLICATIONS

Molex Incoporated Drawing No. PS–70929 Sheet 2 and 6.

*Primary Examiner*—Khiem Nguyen
*Attorney, Agent, or Firm*—Charles S. Cohen

[57] ABSTRACT

An elongated connector includes an elongated dielectric housing having a longitudinal cavity defining a transverse insertion axis for axially receiving a plurality of terminal modules. A plurality of elongated terminal modules each include a longitudinal dielectric insert receivable in the cavity in a side-by-side array of modules. The inserts mount a plurality of terminals having portions projecting therefrom. Complementary interengaging latches are provided on opposite longitudinal sides of each insert of each terminal module for latching the modules in their side-by-side array at least against relative movement in a plane extending longitudinally of the modules and axially of the cavity. The latches are configured for latching interengagement regardless of the longitudinal orientation of any of the modules within the cavity.

12 Claims, 6 Drawing Sheets

ELECTRICAL CONNECTOR HAVING TERMINAL MODULES

FIELD OF THE INVENTION

This invention generally relates to the art of electrical connectors and, particularly, to an electrical connector which includes a plurality of separate terminal modules mountable within a connector housing regardless of their orientation.

BACKGROUND OF THE INVENTION

A known type of input/output (I/O) electrical connector includes an elongated dielectric housing having a front mating face and rear face with a terminal module-receiving cavity extending therebetween. A plurality of terminal modules are insertable into the cavity, with each module including a dielectric insert or strip surrounding a plurality of terminals. The dielectric insert may be overmolded about body sections of the plurality of terminals.

For instance, thin elongated terminal modules may be positioned in a side-by-side or "stacked" array within the housing cavity. In order to hold the modules within the cavities, various latch means are provided. The latch means can vary from interengaging latches between adjacent modules, interengaging latches between the modules and the housing and completely separate latching devices. Systems using separate latching devices add considerably to the cost of the connectors and, in some applications, are simply cost prohibitive. Molded interengaging latches between adjacent modules or between the modules and the housing are cost effective and most often preferred.

A problem with most integral latching systems of the prior art is that they are in one way or another asymmetrical. In other words, the terminal modules must be positioned in a particular alignment or orientation in order to assemble the modules within the connector housing cavity. This is a time consuming and expensive procedure. In fact, totally separate alignment stations have been provided during processing of some connectors, with the alignment stations being quite expensive.

The present invention is directed to solving these problems by providing a connector assembly which uses terminal modules that are configured to be symmetrical to the extent that the modules can be inserted into the connector housing cavity regardless of the orientation of any of the modules.

SUMMARY OF THE INVENTION

An object, therefore, of the invention is to provide a new and improved electrical connector with terminal modules which can be assembled in the connector regardless of their orientation.

In the exemplary embodiment of the invention, an elongated electrical connector includes an elongated dielectric housing having a longitudinal cavity defining a transverse insertion axis for axially receiving a plurality of terminal modules. A plurality of elongated terminal modules each include a longitudinal dielectric insert receivable in the cavity in a side-by-side array of modules. The inserts mount a plurality of terminals having portions projecting therefrom. Generally, complementary interengaging latch means are provided on opposite longitudinal sides of each insert of each terminal module for latching the modules in the side-by-side array at least against relative movement in a plane extending longitudinally of the modules and axially of the cavity. The latch means are configured for latching interengagement regardless of the longitudinal orientation of any of the modules within the cavity.

More particularly, the complementary interengaging latch means are provided by a plurality of longitudinally spaced latch projections and a plurality of equally longitudinally spaced latch recesses similarly located on each opposite side of each insert of each terminal module. In addition, complementary latch recesses are provided in the housing within the cavity and located for receiving the latch projections on the inserts of the outermost terminal modules in their side-by-side array.

In addition, positioning means are provided on each opposite end of each module insert engageable with complementary positioning means at each opposite end of the longitudinal cavity in the elongated housing. As disclosed herein, the positioning means and the complementary positioning means comprise slidable interengaging rib and groove means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
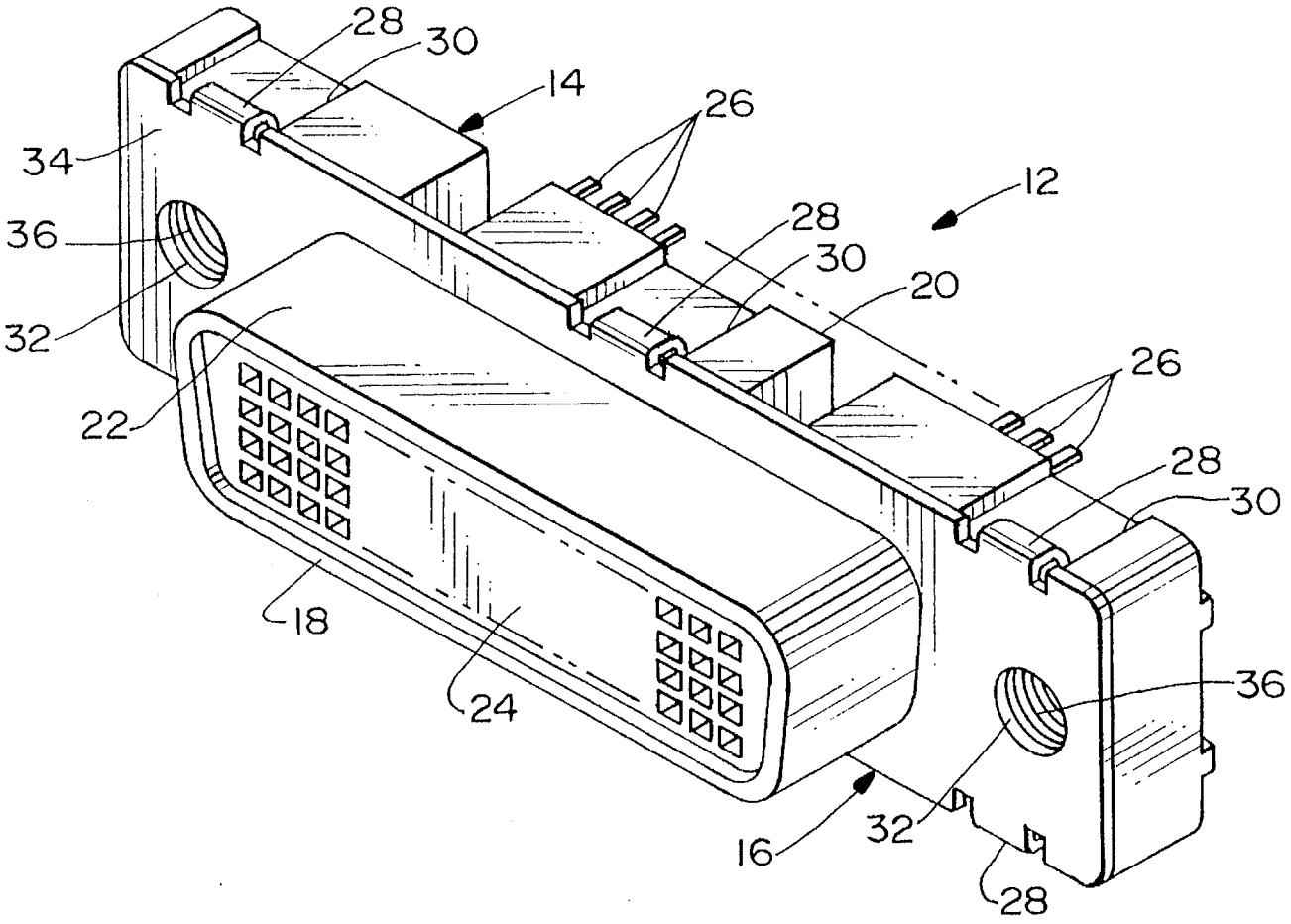
FIG. 1 is a perspective view of an electrical connector embodying the concepts of the invention.
Figure 3:
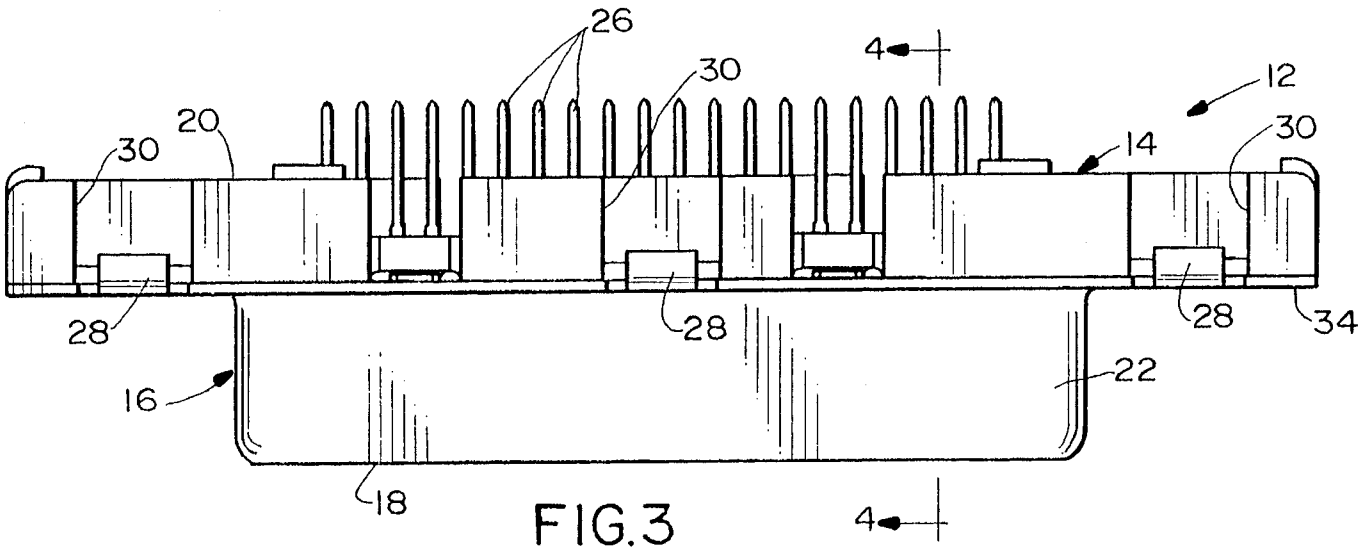
FIG. 3 is a top plan view of the connector.
Figure 2:
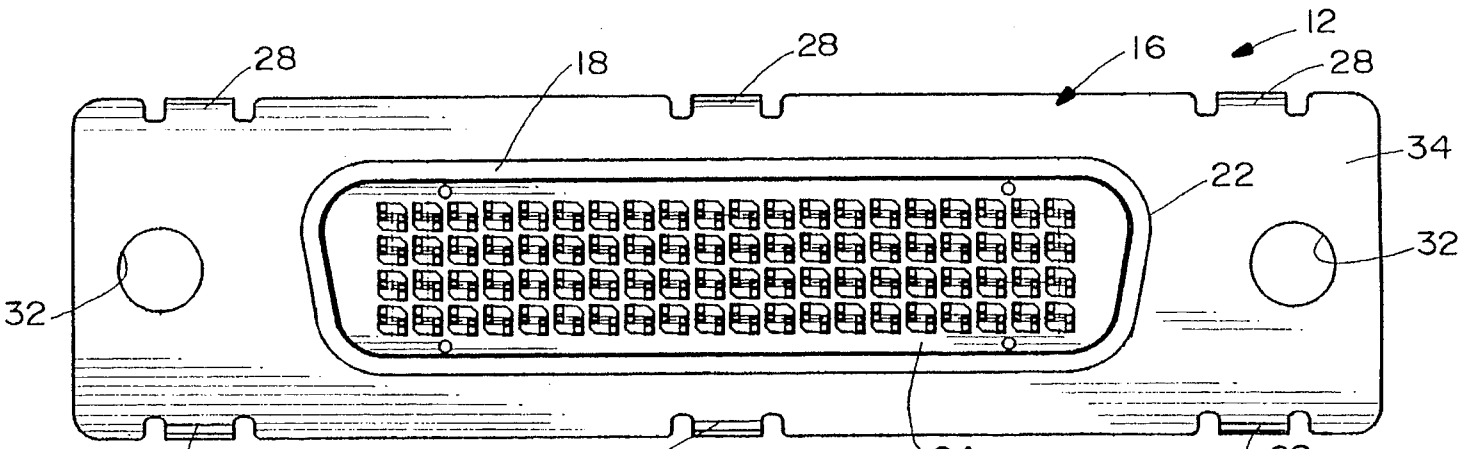
FIG. 2 is a front elevational view of the connector.

Referring to the drawings in greater detail, and first to FIGS. 1–4, the invention is embodied in an electrical connector, generally designated 12, which includes an elongated dielectric housing, generally designated 14, and a front shield, generally designated 16. Housing 14 is a one-piece structure unitarily molded of dielectric material such as plastic or the like. Shield 16 is a one-piece structure stamped and formed of sheet metal material. The connector is an input/output (I/O) electrical device wherein shield 16 defines a front mating face 18 of the connector, and housing 14 defines a rear terminating face 20. The front face actually is formed by a D-shaped shroud portion 22 of the shield surrounding a forwardly projecting mating portion 24 of the housing within the shroud portion. Tail portions 26 of a plurality of terminals (described hereinafter) project from rear face 20 of the connector for insertion into appropriate holes in a printed circuit board for connection to circuit traces on the board and/or in the holes. As best seen in FIG. 1, rearwardly formed tabs 28 of shield 16 embrace housing 14 within recesses 30 therein. Lastly, holes 32 in a base plate 34 of shield 16 are aligned with internally threaded inserts 36 in housing 14 for receiving appropriate threaded fasteners for fastening the connector to a panel and/or to a complementary mating connector.

Figure 4:
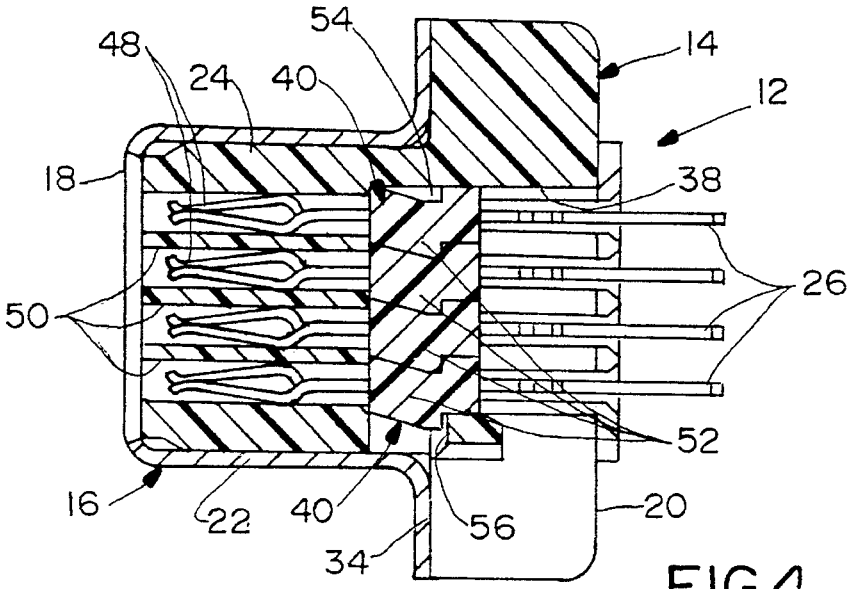
FIG. 4 is a vertical section, on an enlarged scale, taken generally along line 4—4 of FIG. 3.

Referring to FIGS. 5–8 in conjunction with FIGS. 1–4 and particularly FIG. 4, housing 14 of connector 12 includes a rearwardly facing longitudinal cavity 38 for receiving a plurality of terminal modules, generally designated 40, in a side-by-side array of modules within the cavity. Each module includes a one-piece, longitudinal dielectric insert 42 (FIGS. 5–8) which is overmolded about body or base sections 44 of a plurality of terminals, generally designated 46. Each terminal includes a bifurcated mating portion 48 and a tail portion 26 extending from opposite sides of body section 48. As best seen in FIG. 4, mating portions 48 of the terminals extend into passages 50 in mating portion 24 of housing 14, and tail portions 26 project outwardly of housing cavity 38 beyond rear terminating face 20 of the connector.

Figure 5:
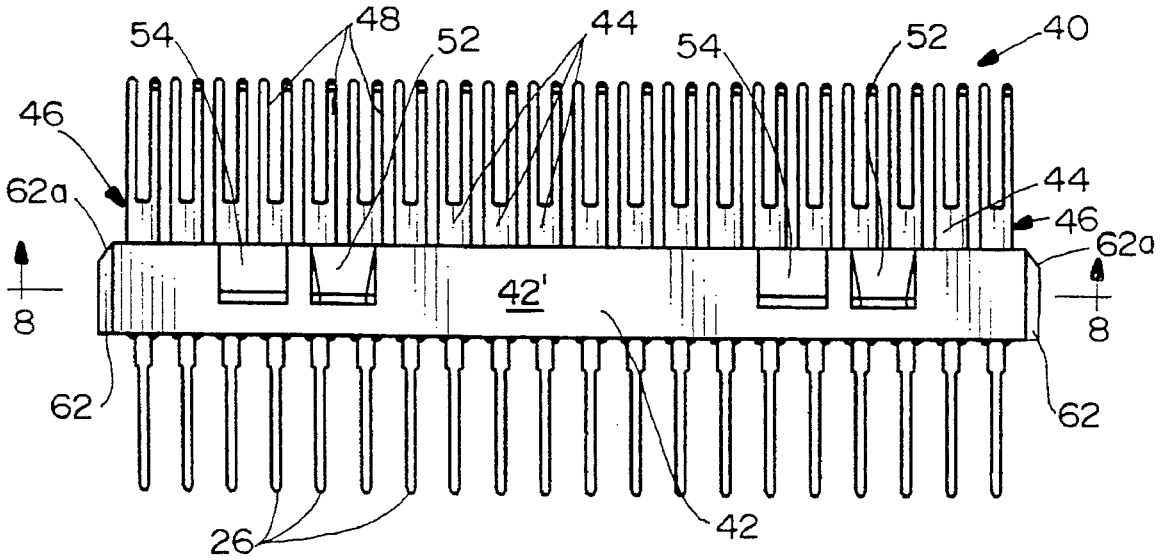
FIG. 5 is a side elevational view, on an enlarged scale, of one of the terminal modules.
Figure 7:
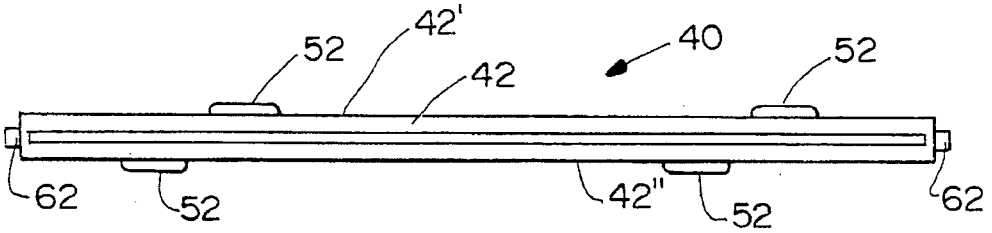
FIG. 7 is a plan view of one of the terminal modules.
Figure 8:
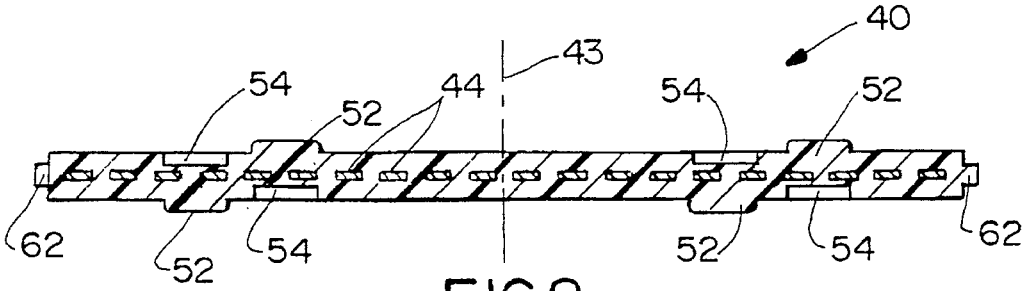
FIG. 8 is a longitudinal section through one of the terminal modules taken generally along line 8—8 of FIG. 5.

Generally, complementary interengaging latch means are provided on opposite longitudinal sides of each dielectric insert 42 of each terminal module 40 for latching the modules in their side-by-side array within housing cavity 38 as shown in FIG. 4. More particularly, the complementary interengaging latch means are provided by a plurality (two) of longitudinally spaced latch projections 52 and a plurality (two) of equally longitudinally spaced latch recesses 54 similarly located on each opposite of each insert 42 of each terminal module 40. The positioning or location of latch projections 52 and latch recesses 54 are best illustrated in FIGS. 5, 7 and 8. As shown in FIG. 8, a latch projection 52 and a latch recess 54 are longitudinally aligned along the inserts 42 but on opposite surfaces 42', 42" thereof. In addition, the recesses 54 and projections 52 are symmetrically positioned on the opposite surfaces 42', 42" about centerline 42 (FIG. 8) of insert 42. In other words, the upper surface 42' to the left in FIG. 8 of centerline 43 has a projection 52 and a recess 54 the same distance from the centerline 43 as the lower surface 42" to the right of centerline 43.

The complementary interengaging latch means provided by latch projections 52 and latch recesses 54 are such as to provide latching interengagement between terminal modules 40 regardless of the longitudinal orientation of any one or all of the modules within housing cavity 38. For instance, taking the module shown in FIG. 7 (or FIG. 8), and reversing the module's longitudinal orientation will result in a configuration identical to that shown in FIG. 7 (or FIG. 8). Therefore, an individual assembling connector 12 does not have to expend time and energy trying to figure out the proper orientation of each module. In fact, the modules can be assembled in a cluster (e.g. four as shown in FIG. 4) and the entire cluster can be inserted into housing cavity 38 regardless of the longitudinal orientation of the cluster. This also obviates the necessity of providing expensive orienting stations in processing I/O connectors as described herein.

Figure 9:
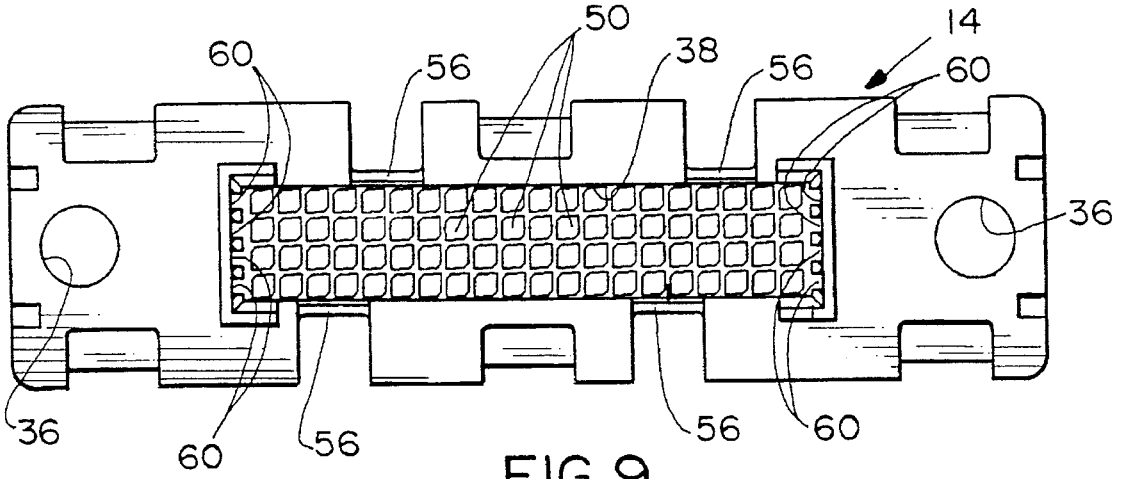
FIG. 9 is a rear elevational view of the connector housing.

As best seen in FIGS. 4 and 9, latch recesses 56 also are provided in housing 14 on opposite sides of cavity 38 and located for receiving latch projections 52 on inserts 42 of the outermost terminal modules 40 in their side-by-side array within the cavity. It can be seen that latch cavities 56 in the housing are positioned in the same locations as the latch projections 52 of each insert 42. As a result, the latch cavities interengage with the latch projections of the outermost terminal modules regardless of the orientation of the modules within cavity 38.

Figure 6:
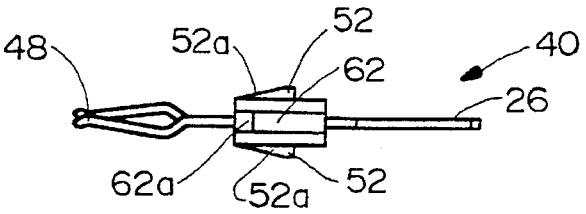
FIG. 6 is an end elevational view of one of the terminal modules.

Generally, positioning means are provided on each opposite end of each module insert 42 engageable with complementary positioning means at each opposite end of longitudinal cavity 38 in housing 14. More particularly, referring to FIG. 9, a plurality of grooves 60 are formed in housing 14 at each opposite end of longitudinal cavity 38. As best seen in FIGS. 5, 7 and 8, ribs 62 are molded integrally with each insert 42 of each terminal module 40. Ribs 62 are dimensioned for sliding into grooves 60 in the housing to properly position the modules therewithin. In order to facilitate insertion of the modules into the housing cavity, ribs 62 are chamfered, as at **62*a* in FIG. 5, to guide the modules into the housing cavity. Also, as seen in FIG. 6, latch projections 52 also are chamfered, as at 52*a***, to further guide the terminal modules into the cavity.

Figure 10:
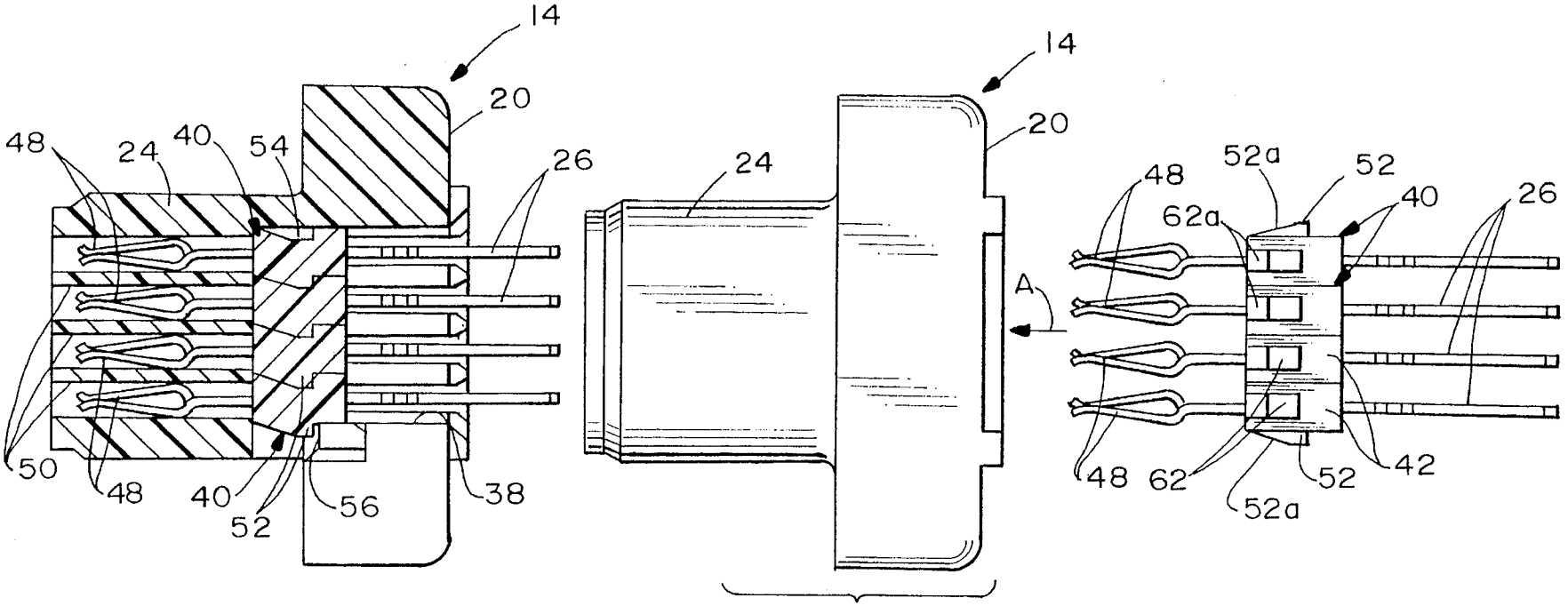
FIG. 10 is a sequential view showing the mounting of a plurality of terminal modules into the connector housing.

FIG. 10 shows a sequential view of assembling a plurality or "cluster" of four terminal modules 40 into connector housing 14. The four modules are shown interengaged by latch projections 52 and latch recesses 54 so that inserts 42 of the modules are in a side-by-side array. The modules then are inserted into housing 14 in the direction of arrow "A". According to the invention, 10 the modules do not have to be aligned in any particular longitudinal orientation. The modules are inserted into cavity 38 in the housing as shown to the left of FIG. 10 which corresponds to the assembled condition of the modules and the housing as shown in and described above in relation to FIG. 4. Again, mating portions 48 of the terminals are located within passages 50 of mating portion 24 of the housing, and tail portions 26 of the terminals project rearwardly of rear face 20 of the housing.

Figure 11:
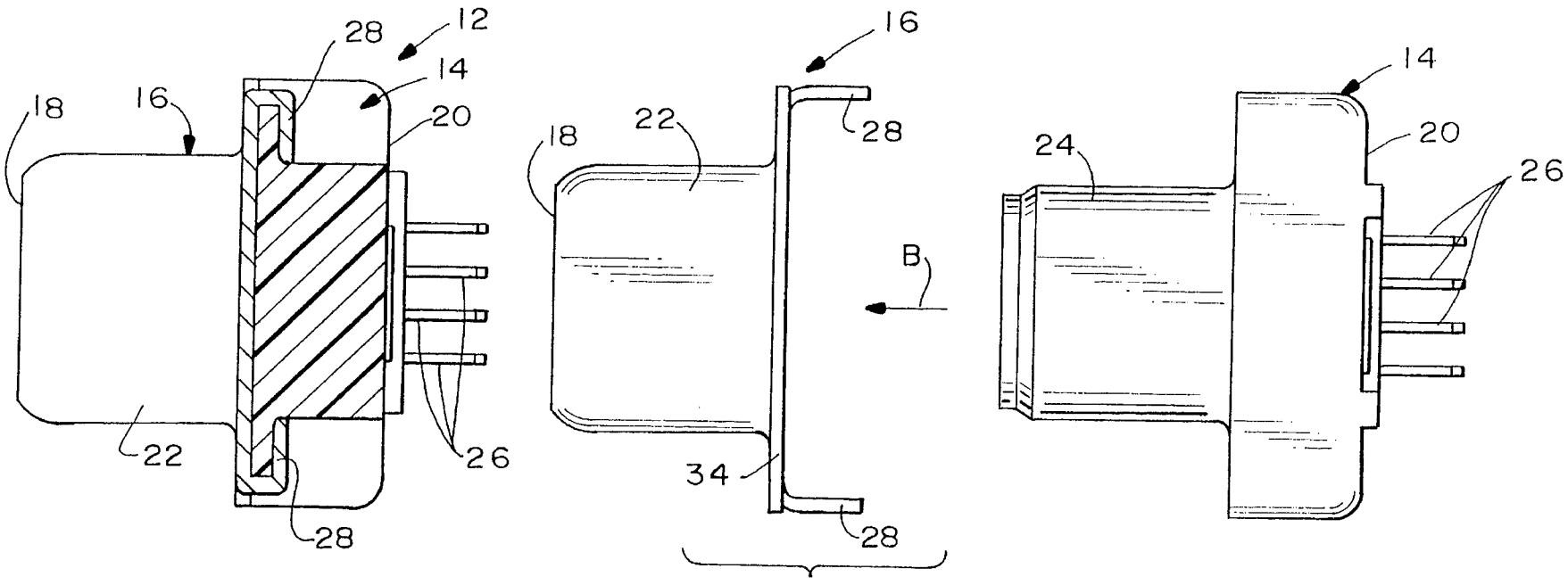
FIG. 11 is a sequential view of mounting the assembly of FIG. 10 into the shell of the connector.

Lastly, FIG. 11 shows the final step in assembling connector 12, whereby the assembly depicted at the left-hand end of FIG. 10 now is inserted into shield 16 in the direction of arrow "B". Mating portion 24 of the housing is assembled into shroud portion 22 of the shield to the position shown in FIG. 4. Tabs 28 of the shield then are bent or formed inwardly as shown to the left in FIG. 11 to clamp the shield to the connector housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An elongated connector, comprising:

an elongated dielectric housing having a longitudinal cavity defining a transverse insertion axis for axially receiving a plurality of terminal modules;

a plurality of elongated terminal modules each including an elongated dielectric insert receivable in said cavity in a side-by-side array of modules, each insert having opposite upper and lower sides and mounting a plurality of terminals having portions projecting from the inserts; and complementary interengaging latch means on said inserts in the form of first and second latch projections and first and second complementary latch recesses, said first latch projection being located on said upper side of said insert a first predetermined distance from a lateral centerline of said insert and said first latch recess being located on said lower side of said insert on an opposite side of said lateral centerline relative to said first latch projection and spaced from said lateral centerline by an amount equal to said first predetermined distance, said second latch projection being located on said lower side of said insert a second predetermined distance from said lateral centerline of said insert and said second latch recess being located on said upper side of said insert on an opposite side of said lateral centerline relative to said second latch projection and spaced from said lateral centerline by an amount equal to said second predetermined distance, said latch projections and recesses latching the modules in said side-by-side array at least against relative movement in a plane extending longitudinally of the modules and axially of said cavity, the latch projections and latch recesses being located for latching interengagement regardless of the longitudinal orientation of any of the modules within the cavity; and latch recesses in the housing within the cavity and located for receiving the latch projections on the inserts of the outermost terminal modules in said side-by-side array thereof.

2. The electrical connector of claim 1, including positioning means on each opposite end of each insert engageable with complementary positioning means at each opposite end of the longitudinal cavity in the elongated housing.

3. The electrical connector of claim 2 wherein said positioning means and said complementary positioning means comprise slidable interengaging rib and groove means.

4. An electrical connector, comprising:

a dielectric housing having a cavity for axially receiving a plurality of terminal modules;

a plurality of terminal modules each including a dielectric insert receivable in said cavity in a side-by-side array of modules, the inserts mounting a plurality of terminals having portions projecting therefrom;

complementary interengaging latch means on each insert of each terminal module for latching the modules in said side-by-side array, the latch means being configured for latching interengagement regardless of any of the modules being oriented in at least two different orientations; and positioning means on each insert of each module engageable with complementary positioning means on the housing regardless of said orientation of the modules within the cavity.

5. The electrical connector of claim 4 wherein said latch means comprise at least one latch projection and at least one complementary latch recess similarly located on opposite sides of each insert of each terminal module.

6. The electrical connector of claim 4, including latch means in the housing within the cavity and located for interengagement with the latch means on the inserts.

7. The electrical connector of claim 4 wherein said positioning means and said complementary positioning means comprise slidable interengaging rib and groove means.

8. An electrical connector, comprising:

a dielectric housing having a cavity for axially receiving a plurality of terminal modules;

a plurality of terminal modules each including a dielectric insert having major sides and minor ends, the inserts being receivable in said cavity in a side-by-side array of modules, and the inserts mounting a plurality of terminals having portions projecting therefrom;

at least one latch projection and at least one complementary latch recess similarly located on each opposite major side of each insert of each terminal module, the latch projections and latch recesses of the inserts in the side-by-side array thereof being interengageable regardless of the orientation of any of the modules within the cavity; and positioning means on each opposite minor end of each insert of each terminal module engageable with complementary positioning means in the cavity regardless of the orientation of any of the modules within the cavity.

9. The electrical connector of claim 8 wherein said positioning means and said complementary positioning means comprise slidable interengaging rib and groove means.

10. The electrical connector of claim 8, including latch recesses in the housing within the cavity and located for receiving the latch projections on the inserts of the outermost terminal modules in said side-by-side array thereof.

11. The electrical connector of claim 8, including a plurality of spaced latch projections and a plurality of equally spaced latch recesses similarly located on each opposite side of each insert of each terminal module.

12. An elongated connector, comprising:

an elongated dielectric housing having a longitudinal cavity defining a transverse insertion axis for axially receiving a plurality of terminal modules;

a plurality of elongated terminal modules each including a longitudinal dielectric insert receivable in said cavity in a side-by-side array of modules, the inserts mounting a plurality of terminals having portions projecting from the inserts; and complementary interengaging latch means on opposite longitudinal sides of each insert of each terminal module for latching the modules in said side-by-side array at least against relative movement in a plane extending longitudinally of the modules and axially of said cavity, the latch means being configured for latching interengagement regardless of the longitudinal orientation of any of the modules within the cavity.

* * * * *